US009064481B2

(12) United States Patent
Whorton et al.

(10) Patent No.: US 9,064,481 B2
(45) Date of Patent: Jun. 23, 2015

(54) MUSICAL INSTRUMENT TRANSDUCER CAVITY

(71) Applicants: Phillip Whorton, Nashville, TN (US); Matthew Kline, Nashville, TN (US)

(72) Inventors: Phillip Whorton, Nashville, TN (US); Matthew Kline, Nashville, TN (US)

(73) Assignee: Gibson Brands, Inc., Nashville, TN (US)

( * ) Notice: Subject to any disclaimer, the term of this patent is extended or adjusted under 35 U.S.C. 154(b) by 0 days.

(21) Appl. No.: 14/373,353

(22) PCT Filed: Jan. 20, 2013

(86) PCT No.: PCT/US2013/022333
§ 371 (c)(1),
(2) Date: Jul. 19, 2014

(87) PCT Pub. No.: WO2013/110012
PCT Pub. Date: Jul. 25, 2013

(65) Prior Publication Data

US 2014/0373703 A1 Dec. 25, 2014

Related U.S. Application Data

(60) Provisional application No. 61/588,182, filed on Jan. 19, 2012.

(51) Int. Cl.
*G10H 1/32* (2006.01)
*G10H 3/00* (2006.01)
*G10H 3/18* (2006.01)

(52) U.S. Cl.
CPC ..... *G10H 3/18* (2013.01)

(58) Field of Classification Search
CPC ..... G10D 1/085; G10H 1/32; G10H 3/183
USPC ..... 84/743, 728, 267, 291
See application file for complete search history.

(56) References Cited

U.S. PATENT DOCUMENTS

| | | | | |
|---|---|---|---|---|
| 3,236,930 | A * | 2/1966 | Fender | 84/728 |
| 4,535,668 | A * | 8/1985 | Schaller | 84/727 |
| 4,869,144 | A * | 9/1989 | Lieber | 84/726 |
| 6,255,567 | B1 | 7/2001 | Minakuchi | |
| 7,002,065 | B2 * | 2/2006 | Petersen | 84/290 |
| 7,145,063 | B2 * | 12/2006 | Redard | 84/267 |
| 8,829,318 | B1 * | 9/2014 | DeLaFrance | 84/292 |
| 2005/0211052 | A1 | 9/2005 | Gigliotti | |
| 2009/0249946 | A1 | 10/2009 | Hunter | |
| 2010/0031807 | A1 | 2/2010 | Fiocco | |

FOREIGN PATENT DOCUMENTS

JP 2006-251244 A 9/2006

* cited by examiner

*Primary Examiner* — Jeffrey Donels
(74) *Attorney, Agent, or Firm* — Bates & Bates, LLC

(57) ABSTRACT

A pickup unit cavity for a stringed musical instrument is provided. The pickup unit cavity comprises a top, a bottom, at least one side, and at least one aperture in the cavity bottom, wherein the depth of the aperture allows for adjustment of a pole piece of a pickup unit. In some embodiments, the depth of the cavity from the top to the bottom is about ½ inch and the depth of the at least one aperture is ½ inch. In certain embodiments, the pickup unit cavity is in a housing. An electrical stringed musical instrument in combination with the pickup unit cavity is additionally provided.

20 Claims, 6 Drawing Sheets

MUSICAL INSTRUMENT TRANSDUCER CAVITY

CROSS-REFERENCE TO RELATED APPLICATION

This Application claims priority to U.S. Provisional Patent Application Ser. No. 61/588,182, filed Jan. 19, 2012, and PCT Application No. PCT/US13/22333, filed Jan. 20, 2013, both of which are hereby incorporated by reference in their entirety.

TECHNICAL FIELD

The field of the disclosure relates generally to cavities in musical instrument bodies for transducers or pickup units. When placed in the cavities, these transducers convert the vibration of the strings of electrical musical instruments into a measurable voltage. More particularly, the disclosure relates to one or more cavities in an electric stringed musical instrument capable of accommodating various transducers, wherein the one or more cavities has a particular depth within a housing attached to an electric stringed musical instrument body or a particular depth directly in the electric stringed musical instrument body.

BACKGROUND

Electromagnetic pickup devices are used in conjunction with electric stringed musical instruments such as electric guitars and basses to convert the vibrations resulting from the movement or "picking" of the strings into electrical signals, for subsequent transmission to amplification devices to produce a desired sound. The pickup is generally positioned under the strings of the instrument on the base surface and the signal transmitted by an electromagnetic pickup is dependent upon the motions of each string.

Pickup devices are commonly fit into cavities within housings that are attached to the musical instrument body or directly into cavities within the body of the musical instrument. In the past, the depth of these cavities was determined by how much depth was needed to adjust particular components of the pickup up or down. For example, the pickup cavity in a Les Paul electric guitar is approximately $\frac{7}{8}^{th}$ inch. However, conventional wisdom holds that the shallower the pickup cavity, the better the tone because of a reduction in the amount of material removed from the cavity.

The most essential components of a pickup are a permanent magnet and a coil of wire. There are several types of pickups with varying coil configurations known in the art. One type of electromagnetic pickup device is a single coil pickup. In a single coil pickup, a single coil portion has a plurality of magnetic pole pieces, with each pole piece associated with a string of the instrument. The pole pieces lie in a place spaced from the common plane of the strings, with each string disposed in a play extending through a space between two adjacent pole pieces, so that a given string at rest is located above and between two adjacent pole pieces. Another type of pickup is a dual coil pickup or a humbucking pickup. In a humbucking pickup, two coils are associated or connected in a manner so as to reduce hum. Dual Coil pickups may also have pole pieces.

There is significant value in a cavity design for a pickup which allows for the least amount of material to be removed from cavity while still allowing the pickup to work for its intended purpose. In many cases, it is also valuable for the cavity design to allow the pickup to be placed on the musical instrument body in an esthetically pleasing manner.

SUMMARY

In one aspect, the present disclosure is directed toward a pickup unit cavity wherein the cavity has a bottom, at least one side, and at least one aperture in the cavity bottom, wherein the depth of the aperture allows for adjustment of a pole piece of a pickup unit. In certain embodiments, the cavity is directly in the body of an electric stringed musical instrument. In other embodiments, the cavity is in a housing which is then connected with the body of a stringed musical instrument. In embodiments utilizing a housing, the housing may be placed in a void such as a standard pickup cavity in the electrical stringed musical instrument body.

In certain aspects, the depth of the pickup unit cavity from the opening of the cavity to the bottom, as well as the depth of the apertures in the cavity bottoms are about ½ inch.

Consistent with yet a further aspect of the disclosure, a guitar with a disclosed pickup unit cavity is claimed.

DETAILED DESCRIPTION

Before describing the exemplary embodiments in detail, it is to be understood that the embodiments are not limited to particular apparatuses or methods, as the apparatuses and methods can, of course, vary. It is also to be understood that the terminology used herein is for the purpose of describing particular embodiments only, and is not intended to be limiting. Unless defined otherwise, all technical and scientific terms used herein have the same meaning as commonly understood by one of ordinary skill in the art to which an embodiment pertains. Many methods and materials similar, modified, or equivalent to those described herein can be used in the practice of the current embodiments without undue experimentation.

As used in this specification and the appended claims, the singular forms "a", "an" and "the" can include plural referents unless the content clearly indicates otherwise. Thus, for example, reference to "a component" can include a combination of two or more components.

Pickup, pickup unit and transducer are used interchangeably throughout this disclosure.

Figure 1:
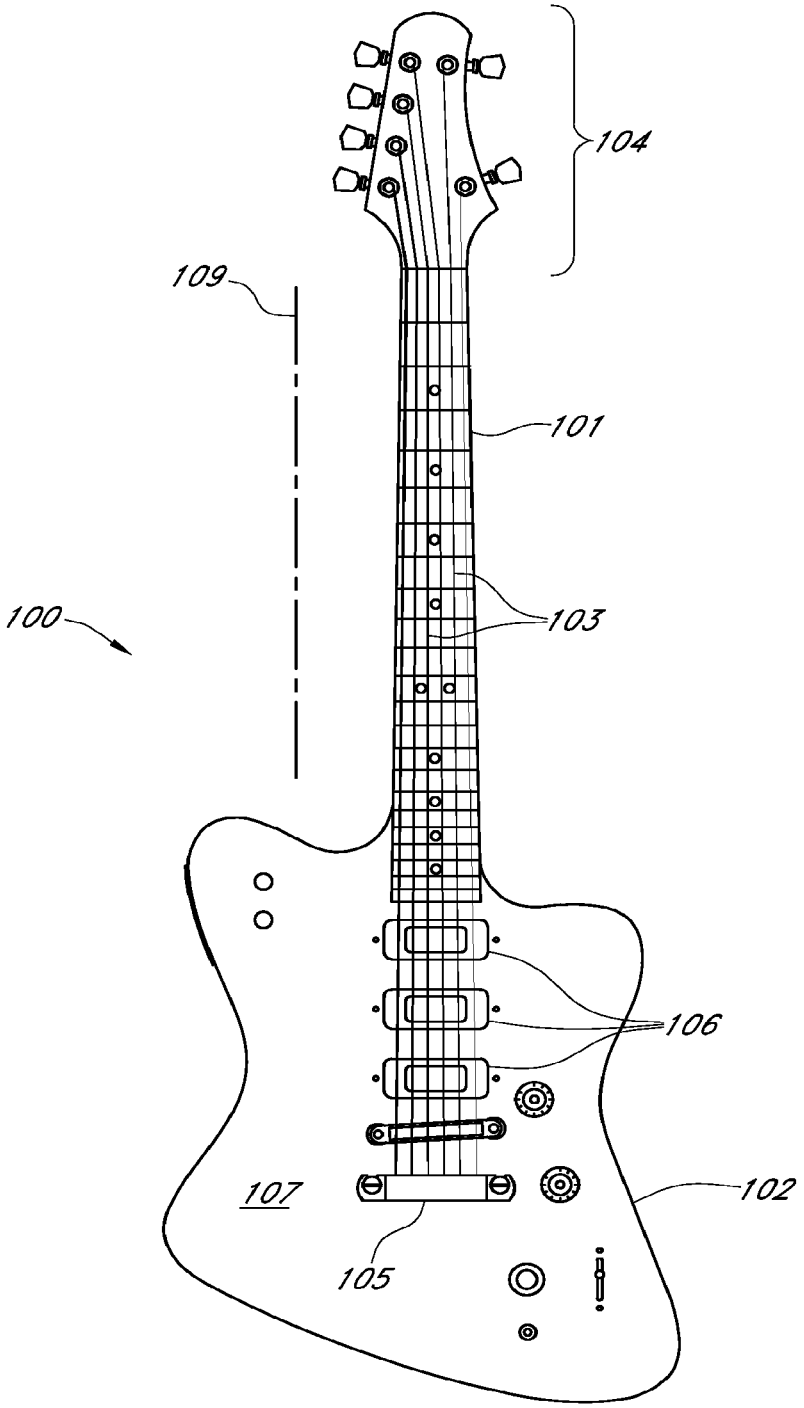
FIG. 1 depicts a front elevational view of a stringed electrical musical instrument with the pickup cavities of the present disclosure.

Exemplary embodiments of the pickup cavity will now be explained with reference to the figures. This description is provided in order to assist in the understanding of the invention and is not intended to limit the scope of the invention to the embodiments shown in the figures or described below. FIG. 1 demonstrates a electrical stringed musical instrument. In the embodiment of FIG. 1, the stringed instrument is a six stringed guitar. However, the components and advantages currently disclosed are applicable to other types of electrical stringed instruments, such as bass guitars, ukuleles, mandolins, violins or guitars with a different number of strings. Referring now to FIG. 1, guitar 100 comprises a neck 101 and a main body 102. The guitar 100 includes guitar strings 103 that are secured on one end to a tuning head 104 and on the other end to a bridge 105 in a manner well known in the art.

FIG. 1 further demonstrates a pair of pickup cavities 106 arrayed beneath the strings 103 in a conventional manner. The pickups cavities may be placed in various positions on the main body 102 of the guitar. The number of pickup cavities in the main body of the guitar is not limiting. In certain embodiments, there will be a single pickup cavity. In other embodiments, there will be two, three, or more pickup cavities. In the event there is more than a single pickup cavity and more than one pickup is used, the pickups may be connected via switches such that one, or more than one, pickup may transmit at a time.

The angle of cavity 106 in respect to the plane 109 of the strings 103 of the musical instrument can vary. In many embodiments, length 113 cavity 106 will generally be perpendicular to plane 109. In other embodiments, the cavity 106 will be at an angle that is not perpendicular to plane 109 of strings 103.

Figure 2A:
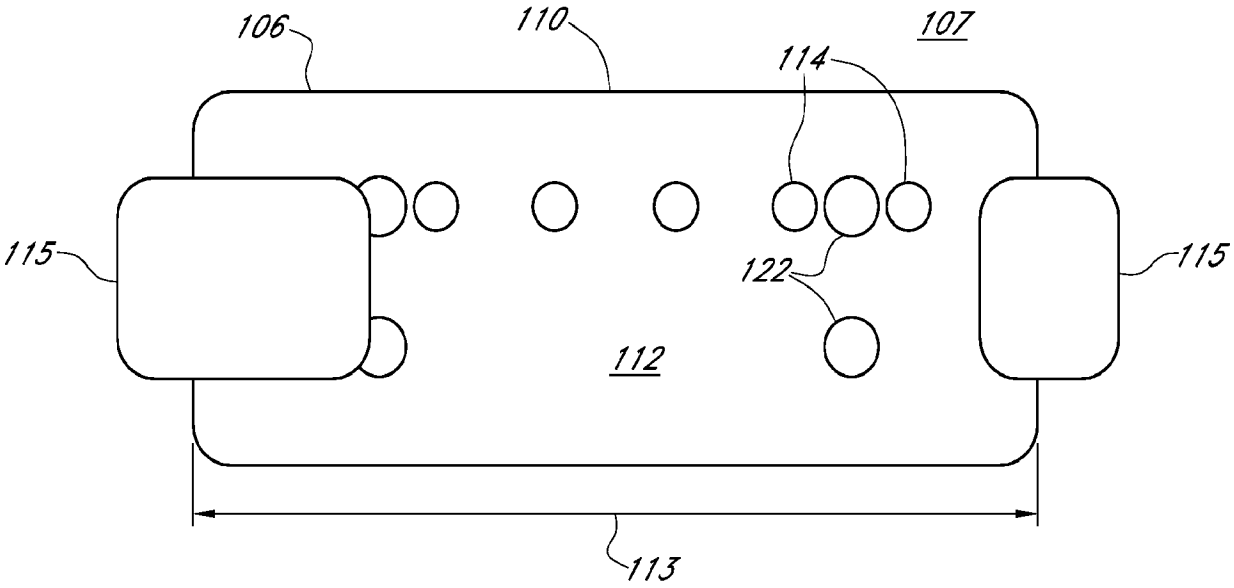
FIGS. 2A and 2B demonstrate from two angles a close up of an example pickup unit cavity.
Figure 2B:
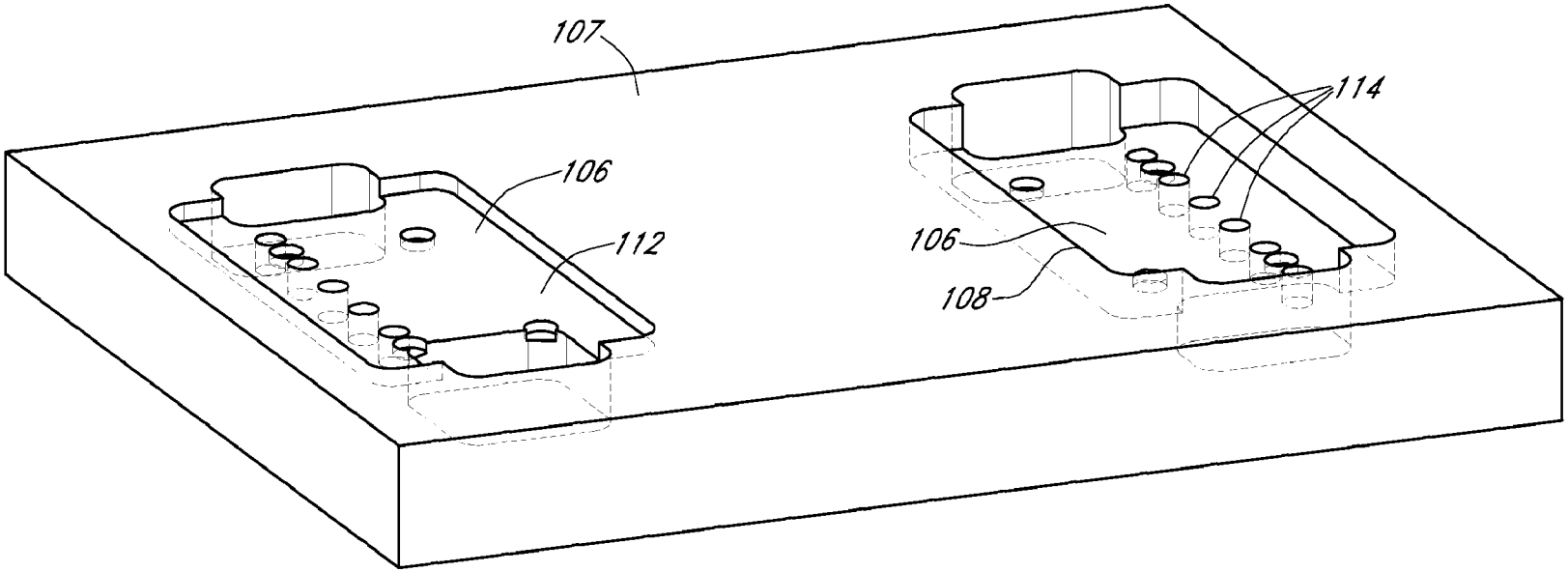

FIGS. 2A and 2B demonstrate pickup unit cavity 106 having an opening 108 on the top of body 102 of musical instrument 100, sides 110, and a bottom 112 containing at least one aperture 114 as well as an opening for connecting the musical instrument electronics (not shown). Although cavity 106 in FIGS. 2A and 2B is placed directly in the body 102 of musical instrument 100, it is contemplated that cavity 106 can be placed in a housing, which is then connected with body 102 of musical instrument 100. As used herein, "housing" is not the same as body 102. In exemplary embodiments, the housing containing the cavity will be connected with the body of musical instrument 100 in the same configuration as would be seen if cavity 106 were directly in the musical instrument body 102. In some embodiments, the housing containing cavity 106 will be placed into a void in the musical instrument body. In other embodiments, the housing will be placed on top of the musical instrument body and connected. The shape of the housing is not met to be limiting. In certain embodiments, the housing will be rectangular in shape.

In most embodiments, cavity 106 is designed to accommodate a pickup unit with at least one permanent magnet, and a coil. The pickup unit will commonly have pole pieces. In certain embodiments, the pole pieces are the permanent magnet, whereas in other embodiments, the pole pieces are magnatizeable material in contact with the permanent magnet. Generally, any type of pickup unit containing a permanent magnet and a coil is contemplated for use in cavity 106. Cavity 106 may be further designed to accommodate different types, as well as numbers and shapes of magnets.

Figure 3:
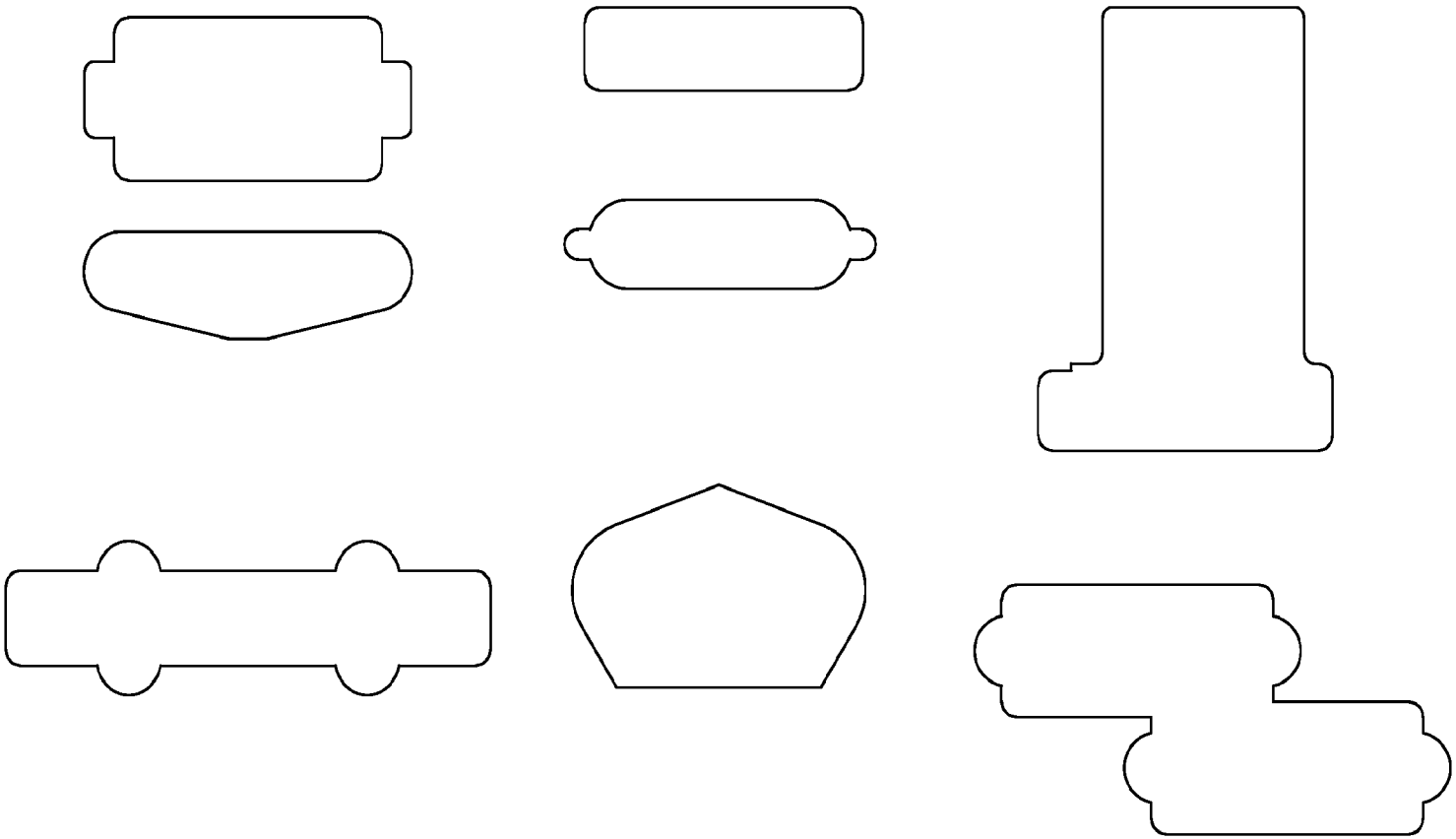
FIG. 3 shows different shaped pickup cavities applicable for use with the present disclosure.

Although cavity 106 may be designed for pickup units without pole pieces, exemplary cavities designed for pickup units with pole pieces are particularly useful, such as the cavities shown in FIG. 2A and FIG. 3. The particular pole piece in a pickup unit for use in cavity 106 is not limiting and the aperture 114 of cavity 106 may accommodate any type of pole piece. In most embodiments, the aperture 114 of cavity 106 will accommodate non-adjustable pole pieces, adjustable pole pieces or both adjustable and non-adjustable pole pieces. In addition to embodiments where the aperture 114 of cavity 106 accommodates a pole piece for each string of the musical instrument 100, aperture 114 of cavity 106 may be designed for pole pieces for less than or more than the number of strings 103 of musical instrument 100 or shaped as a blade or as a rail.

The general shape (versus the depth or apertures) of cavity 106 is not limiting. As demonstrated best in the illustrative embodiment of FIG. 3, the shape of cavity 106 may accommodate different shapes of pickup units such as rectangular, rectangular with ears 115, slot shaped, etc. FIG. 3 demonstrates the general shape of some of the commonly known pickup unit cavities currently in use.

Figure 4:
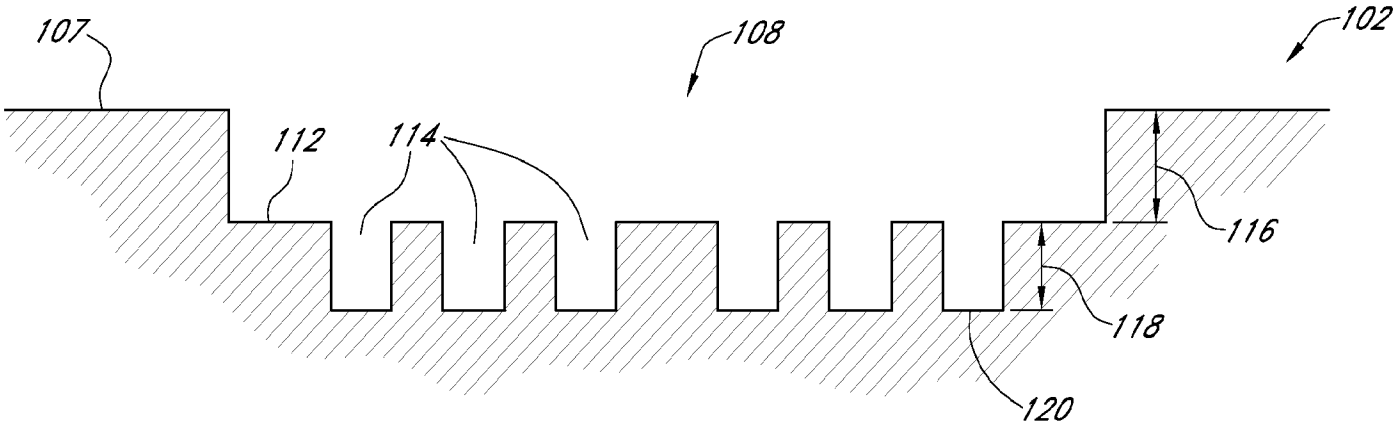
FIG. 4 depicts a side view of the pickup cavity showing the depths of the cavity and the apertures.

FIG. 4 illustrates the important depths of cavity 106. As measured from the top 107 of body 102 of musical instrument 100 or the top of the housing containing cavity 106 (such tops which are equivalent for depth measurement to the opening of cavity 106), in one embodiment, the depth 116 from the top 107 of body 102 or the top of the housing containing cavity 106 to the bottom 112 of cavity 106 is ½ inch. Depth 116 is also present in an embodiment where a housing contains cavity 106. In that event, the depth will be measured from the top of the housing to the bottom 112 of cavity 106. In both the embodiment shown in FIG. 4 and an embodiment where cavity 106 is in a housing, depth 118 from bottom 112 of cavity 106 to bottom 120 of aperture 114 is ½ inch. In another embodiment, depth 116 is less than ½ inch, with aperture depth 118 of more than ½ inch. In yet another embodiment, depth 116 is ¾ inch, with aperture depth 118 of ½ inch. Generally depth 116 plus aperture depth 118 allow for the pickup unit pole pieces to be fully adjustable.

In certain embodiments, a housing containing cavity 106 is the shape of a block. This block can be placed into a pickup unit cavity using any method known in the art. In many embodiments, the pickup unit cavity will be a standard pickup unit cavity. The resulting depth of the pickup unit cavity is reduced by the block while apertures 114 in the block still allow for adjustment of a pickup unit. Similarly to disclosed cavities 106 directly in body 102, the shape versus depth of cavities having housings with apertures 114 is not limiting and may be any shape known in the art.

Figure 5:
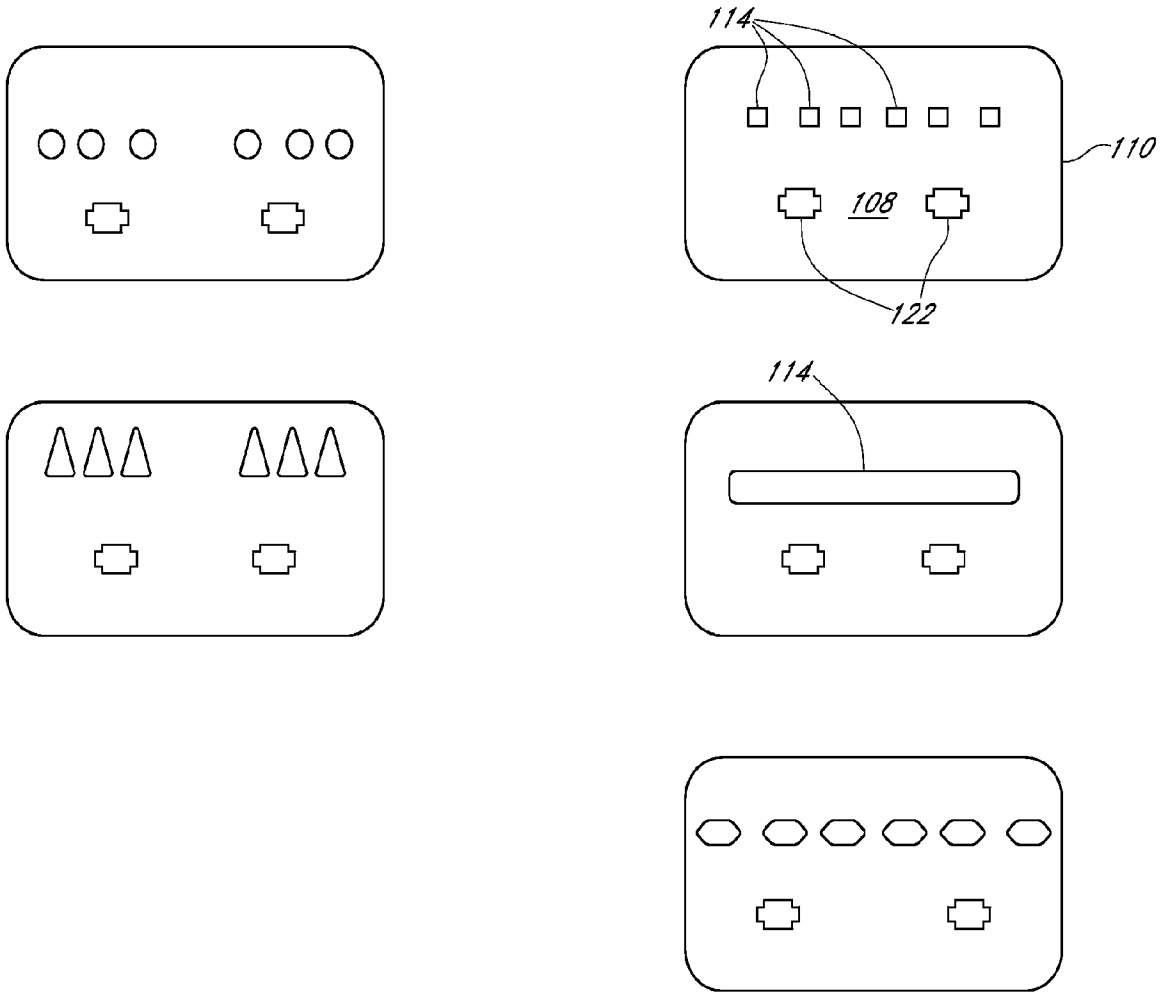
FIG. 5 illustrates various shaped apertures within the floor of the pickup cavity.

The number of apertures 114 is not meant to be limiting. In many embodiments, the number of apertures 114 will be equal to the number of pole pieces of the desired pickup unit plus connector apertures 122 for assisting in attachment of the pickup unit to the musical instrument body. Connector apertures 122 are commonly shallower than apertures 114, which accept the pole pieces. In most embodiments, connector apertures 122 will be sized to accept connectors such as screws. In some embodiments, connector apertures 122 have a depth capable of allowing adjustment of the entire pickup unit. In exemplary embodiments, such as those demonstrated in FIG. 4 and FIG. 5, only apertures 114 are present and equal to the number of pole pieces. In these embodiments, the pickup unit is fitted into cavity 106 using methods not requiring screw type fasteners.

The position of apertures 114 may also vary. In many embodiments, all of apertures 114 will be linear in relation to each other. In other embodiments, some of apertures 114 will be linear in relation to each other while other of apertures 114 will be in different configurations.

In musical instruments having more than a single pickup unit cavity 106, depth 116 and depth 118 may be either the same or different in different cavities 106. For example, in a musical instrument having two cavities 106, the first cavity may have a depth 116 of ½ inch, whereas the second cavity may have a depth 116 of ¾ inch. In these cavities, aperture depth 118 may also be the same or different.

In many embodiments, apertures 114 are generally the same shape as the pole piece such that the pole piece is surrounded by the body 102 of musical instrument 100 when a pickup unit is placed in cavity 106. In these embodiments, aperture 114 is slightly larger than the size of the pole piece of the pickup unit. In other embodiments, such as those demonstrated by FIG. 5, aperture 114 is a different shape than the pole piece (assuming that the pole piece is cylindrical). Generally, as long as aperture 114 allows for adjustment of the pole piece in a plane perpendicular to plane 109, aperture 114 may be any shape. For example, FIG. 5 demonstrates apertures 114 as cylindrical (common shape of pole pieces), rectangular, square, slot, etc.

Any aspect or design described herein as "exemplary" is not necessarily to be construed as preferred or advantageous over other aspects or designs. Exemplary embodiments may be implemented as a method, apparatus, or article of manufacture. The word "exemplary" is used herein to mean serving as an example, instance, or illustration.

From the above discussion, one skilled in the art can ascertain the essential characteristics of the invention, and without departing from the spirit and scope thereof, can make various changes and modifications of the embodiments to adapt to various uses and conditions. Thus, various modifications of the embodiments, in addition to those shown and described herein, will be apparent to those skilled in the art from the foregoing description. Such modifications are also intended to fall within the scope of the appended claims.

What is claimed is:

1. A pickup unit cavity for a stringed electrical musical instrument comprising:

a cavity with an opening, bottom, and at least one side; and at least one aperture in the cavity bottom, wherein a depth of the at least one aperture allows for adjustment of a pole piece of a pickup unit.

2. The pickup unit cavity of claim 1, wherein the cavity has four sides.

3. The pickup unit cavity of claim 1, wherein the cavity is rectangular.

4. The pickup unit cavity of claim 3, further comprising ears, wherein the ears consist of additional cavities present on opposite sides of the rectangular cavity.

5. The pickup unit cavity of claim 1, wherein the cavity is slot shaped.

6. The pickup unit cavity of claim 1, wherein the cavity is oval.

7. The pickup unit cavity of claim 1, wherein a depth from the opening to the bottom is about ½ inch.

8. The pickup unit cavity of claim 1, where a depth form the opening to the bottom is about ¾inch.

9. The pickup unit cavity of claim 1, wherein the aperture in the cavity bottom is cylindrical.

10. The pickup unit cavity of claim 1, further comprising six apertures.

11. The pickup unit cavity of claim 1, wherein a depth of the aperture is about ½ inch.

12. The pickup unit cavity of claim 1, wherein a depth of the aperture is less than about ½ inch.

13. The pickup unit cavity of claim 1, wherein a depth of the aperture is more than about ½ inch.

14. The pickup unit cavity of claim 1 further comprising two cavities.

15. The pickup unit cavity of claim 1 further comprising more than two cavities.

16. The pickup unit cavity of claim 1 further comprising a housing, wherein the housing contains the cavity.

17. The pickup unit cavity of claim 1, wherein a pickup unit cavity is perpendicular to a string plane of the musical instrument.

18. The pickup unit cavity of claim 1, wherein a pickup unit cavity is not perpendicular to a string plane of the musical instrument.

19. A method for adjusting a pickup unit within a pickup cavity, comprising:

adjusting at least one pole piece of a pickup unit in an aperture in the pickup cavity of claim 1.

20. The method of claim 19, wherein the aperture has a same general shape as the pole piece.

* * * * *